United States Patent [19]

Johnson

[11] Patent Number: 4,941,016

[45] Date of Patent: Jul. 10, 1990

[54] PHOTOCONDUCTIVE IMAGE RECEIVING MEMBER WITH OPTIMIZED LIGHT RESPONSE CHARACTERISTICS

[75] Inventor: Kevin M. Johnson, Rochester, N.Y.

[73] Assignee: Eastman Kodak Company, Rochester, N.Y.

[21] Appl. No.: 290,673

[22] Filed: Dec. 27, 1988

[51] Int. Cl.[5] ..... G03G 15/04

[52] U.S. Cl. ..... 355/202; 355/211

[58] Field of Search ..... 355/202, 210, 211, 212, 355/326; 430/56, 57

[56] References Cited

U.S. PATENT DOCUMENTS 4,308,821 1/1982 Matsumoto et al. ..... 355/326 X 4,640,601 2/1987 Deguchi et al. ..... 355/3 R

*Primary Examiner*—Joan H. Pendegrass

*Attorney, Agent, or Firm*—Lawrence P. Kessler

[57] ABSTRACT

A photoconductive image receiving member for an electrostatographic reproduction apparatus capable of optical copying and nonimpact printing. The electrostatographic reproduction apparatus includes an assembly for producing a direct light image of a document for optical copying of such document, an assembly for producing an electronically generated light image of information for nonimpact printing of such information, and a photoconductive image receiving member upon which direct light and electronically generated light images are exposed to produce corresponding latent image charge patterns. The photoconductive image receiving member comprises a first portion having characteristics optimized to be responsive to light in the range of direct light produced by the direct light image producing assembly, and a second portion having characteristics optimized to be responsive to light in the range of light produced by the electronically generated light image producing assembly.

7 Claims, 2 Drawing Sheets

PHOTOCONDUCTIVE IMAGE RECEIVING MEMBER WITH OPTIMIZED LIGHT RESPONSE CHARACTERISTICS

BACKGROUND OF THE INVENTION

This invention relates in general to electrostatographic reproduction apparatus, and more particularly to a photoconductive image receiving member with optimized light response characteristics for an electrostatographic reproduction apparatus capable of both optical copying and nonimpact printing.

In reproduction apparatus, such as electrostatographic reproduction apparatus for example, it is general practice to provide an electrostatic image receiving member movable along a path relative to electrostatographic process stations. The electrostatic image receiving member may be in the form of a roller or web guided for movement along the path by support rollers. In the electrostatographic process stations, a uniform electrostatic charge is applied to the member and such charge is modified in an area of the member to form, in such area, a latent image charge pattern corresponding to information to be reproduced. The latent image charge pattern is then developed by applying pigmented marking particles to the member, and the developed image is then transferred to a final receiver member and fixed thereto by heat and/or pressure for example.

The mechanism by which modification of the uniform electrostatic charge pattern to form the latent image is accomplished is dependent upon the characteristics of the image receiving member. If the image receiving member is of the type having a photoconductive layer, charge modification is accomplished by exposing the member to light in an image-wise pattern. Exposing of a image receiving member having a photoconductive layer has typically been accomplished by one of two methods. One method of exposure involves forming a light image of a document (referred to generally as optical copying). In this method, light is directed from a lamp assembly at a document with the light reflected from (or transmitted through) the document being directed by a lens unit into focus on the photoconductive surface. The light from the lamp may illuminate the entire document at one time (referred to as flash exposure), or may be passed through a slit and moved relative to the document to illuminate successive line segments of the document (referred to as scan exposure).

The second method of exposure involves the use of an electronically controlled light emitting assembly (referred to generally as nonimpact printing). Examples of electronically controlled light emitting assemblies include lasers, electrooptic gating devices, or arrays of light emitting diodes (LED's). The light emitting element(s) of an electronically controlled light emitting assembly is selectively turned on and off to produce a beam (or individual beams) of light focused on the photoconductive surface of the image receiving member in order to expose the photoconductive surface in a line-by-line fashion. Information to be reproduced is electronically generated and is used to control the turning on and off of the light emitting assembly to form a desired charge pattern creating a latent image on the member corresponding in an image-wise configuration to the information to be reproduced.

Certain electrostatographic reproduction apparatus in use today employ both image formation with visible light and image formation with electronically controlled light emitting elements (i.e., such apparatus are capable of both optical copying and nonimpact printing). Visible light is, of course in the range of 4000–7700 angstroms. However, certain common electronically controlled light emitting elements are biased toward the infrared range (i.e., greater than 7000 angstroms). The response characteristics of photoconductive image receiving members are generally suitable for optimization in either the visible range or the infrared range, but not both. In order to provide response sensitivity over a range to cover both visible light exposure and infrared exposure, it has been suggested that a photoconductive member have multiple layers of different response characteristics (see for example U.S. Pat. No. 4,607,934 issued Aug. 26, 1986 in the names of Kohyama et al). Such multi-layer photoconductive member construction would, however, be difficult to fabricate and one layer may adversely effect the sensitivity of another layer such that the overall sensitivity of the photoconductive member is degraded over some particular wave length ranges.

SUMMARY OF THE INVENTION

This invention is directed to a photoconductive image receiving member for an electrostatographic reproduction apparatus capable of optical copying and nonimpact printing. The electrostatographic reproduction apparatus includes an assembly for producing a direct light image of a document for optical copying of such document, an assembly for producing an electronically generated light image of information for nonimpact printing of such information, and a photoconductive image receiving member upon which direct light and electronically generated light images are exposed to produce corresponding latent image charge patterns. The photoconductive image receiving member comprises a first portion having characteristics optimized to be responsive to light, in the range of direct light produced by the direct light image producing assembly, and a second portion having characteristics optimized to be responsive to light in the range of light produced by the electronically generated light image producing assembly.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
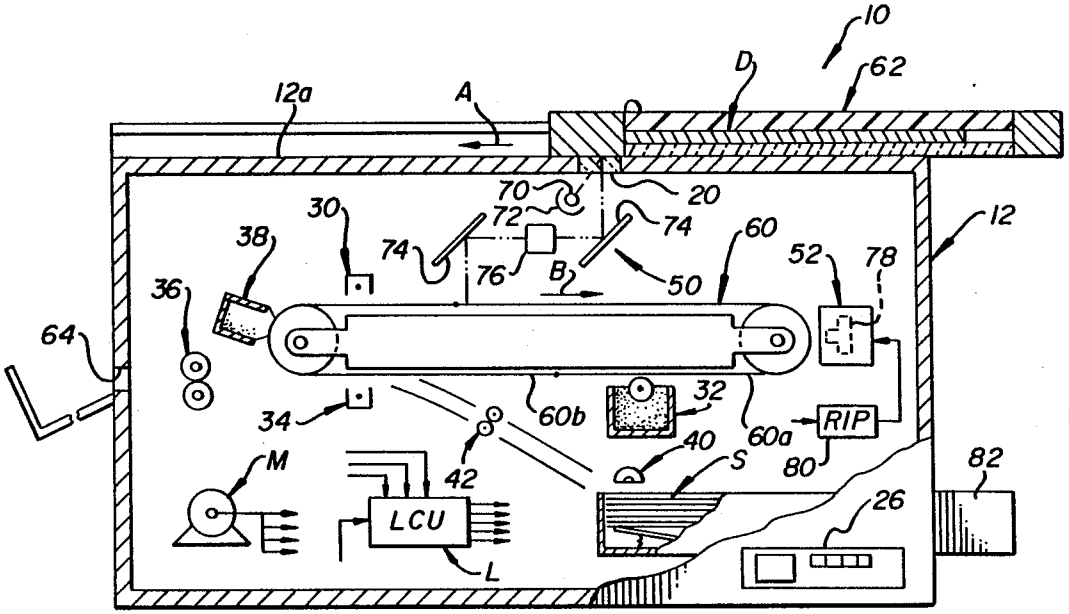
FIG. 1 is a schematic side elevational view, partly in cross-section, of an exemplary electrostatographic reproduction apparatus capable of optical copying and nonimpact printing utilizing a photoconductive image receiving member according to this invention.

Referring now to the accompanying drawing, FIG. 1 schematically shows an electrostatographic reproduction apparatus, designated generally by the numeral 10, particularly suitable for optical copying and nonimpact printing. Of course, the reproduction apparatus 10 is only exemplary, and this invention is suitable for use with other multi-mode electrostatographic reproduction apparatus. The reproduction apparatus 10 includes a housing 12 having a transparent platen 20, formed in the top surface 12*a* thereof. A control panel 26, located at the bottom front of the housing 12, is operatively coupled to a logic and control unit L for the apparatus 10, and enables an operator to select operating parameters for the apparatus and monitor its functions. The logic and control unit L includes, for example, a microprocessor receiving operator input signals and timing signals. Based on such signals and a program from the microprocessor, the unit L produces signals to control the operation of the apparatus 10 for carrying out the reproduction process.

The various elements utilized in the electrostatographic process for image reproduction are located within the housing 12. Such elements include a primary charger 30, a magnetic brush developer station 32, a transfer charger 34, a heat/pressure fuser assembly 36, a cleaning mechanism 38, a receiver member feed mechanism 40, receiver member registration mechanism 42, and a motor M for effecting drive operation of various components and elements of the apparatus 10. Further, the housing 12 contains a suitably located optical exposure assembly 50, an electronically controlled light emitting assembly 52, and an assembly 54 for supporting an image receiving member in the form of a continuous photoconductive belt 60.

Figure 2:
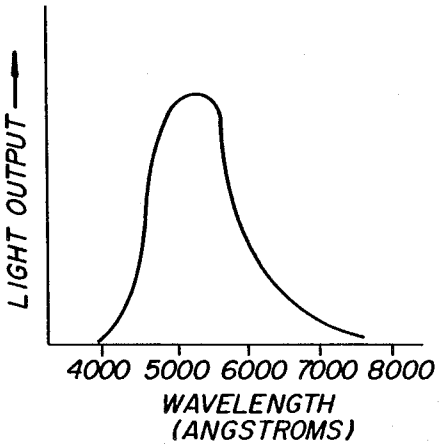
FIG. 2 is a graphical representation plotting visible light output against wavelength for a typical optical exposure assembly of the reproduction apparatus of FIG. 1.
Figure 3:
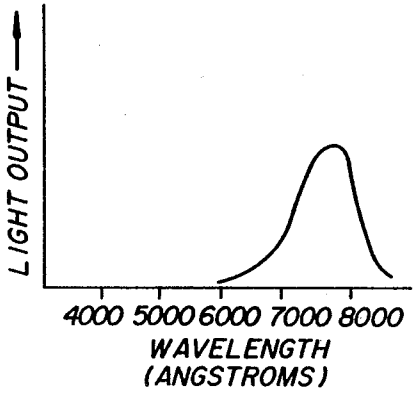
FIG. 3 is a graphical representation plotting electronically produced light output against wavelength for a typical electronically controlled light emitting assembly of the reproduction apparatus of FIG. 1.

This invention is suitable for use with many optical exposure assemblies and electronically controlled light emitting assemblies well known in the art. For the sake of simplicity in understanding this invention, the particular exemplary optical exposure assembly 50 shown in FIG. 1 includes an exposure lamp 70, a reflector 72, mirrors 74, and a lens 76. The lamp 70 emits light in the visible range (i.e., having a wavelength in the range of, 4000–7000 angstroms); see FIG. 2. The electronically controlled assembly 52 includes a print head 78 having light emitting elements such as a plurality of LED's and a linear lens array. The LED's emit light biased toward the infrared range (i.e. having a wavelength above 7000 angstroms); see FIG. 3.

To accomplish optical copying, a carriage 62 adapted to carry a document (designated by the letter D) is movable across the platen 20 in the direction of arrow A. Utilizing the optical exposure assembly 50, light from the lamp 70 is directed by the reflector 72 off the document D as it is moved by the carriage 60 across the platen 20 in order to form a reflected light image, line-by-line, of the document. Such image is directed by the mirrors 74 and lens 76 in focus onto the uniformly charged surface of the belt 60 to form a corresponding latent image charge pattern thereon.

On the other hand, to accomplish nonimpact printing, electronically generated information, typically produced by a host computer (or computers) in the form of digital electrical signals, is fed to a raster image processor (RIP) 80 under the control of the unit L. The RIP 80 also interfaces with a font cartridge which directs the RIP to form the signals from the computer into a serial train of signals in a particular form corresponding, for example, to a particular style type face for the reproduction. The RIP 80 then feeds the appropriate signal train to a driver coupled to the print head 78 of the electronically controlled light emitting assembly 52 for reproducing electrically generated information. Activation of the print head reproduces the signals in the selected image pattern by appropriate turning on of the LED's to expose the uniformly charged surface of the belt 60 to form, line-by-line, a corresponding latent image charge pattern thereon.

Figure 5:
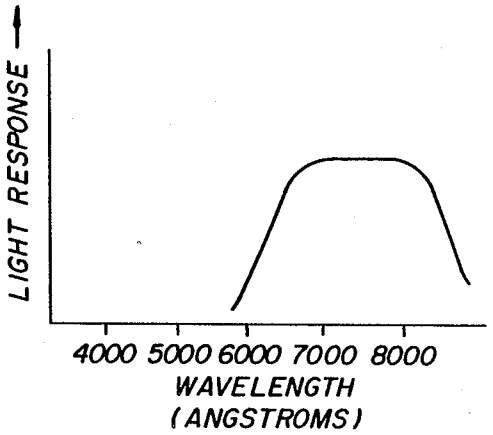
FIG. 5 is a graphical representation of the light response characteristics of another portion of the photoconductive image receiving member according to this invention.
Figure 4:
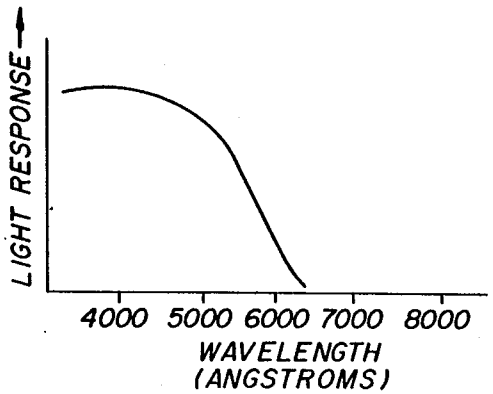
FIG. 4 is a graphical representation of the light response characteristics of a first portion of the photoconductive image receiving member according to this invention.

According to this invention, belt 60 is a composite dielectric member including a photoconductive material layer coated on a support layer. In order to enable the response characteristics of the photoconductive material to be optimized relative to the light output of the optical exposure assembly 50 and the electronically controlled light emitting assembly 52, the belt 60 is formed as two independent segments (60*a* and 60*b*) joined together in end-to-end relation by any well known technique such as heat seaming or ultrasonic welding for example to provide a continuous loop. Alternatively, of course, the belt could be a unitary structure having different photoconductive layer coatings in adjacent areas along the length of the belt. The photoconductive layer of segment 60*a* includes for example material of the type disclosed in U.S. Pat. Nos. 3,615,414 (issued Oct. 26, 1971 in the name of Light) or 3,679,408 (issued Jul. 25, 1972 in the names of Kryman et al.). As shown in FIG. 4, material of this type has an optimum response to light having a wavelength in the range of between 4000–7000 angstroms. On the other hand, the photoconductive layer of segment 60*b* includes for example material of the type disclosed in U.S. Pat. Nos. 4,471,039 (issued Sept. 11, 1984 in the names of Borsenberger et al.), or 4,719,163 (issued Jan. 12, 1988 in the names of Staudenmayer et al.). As shown in FIG. 5, material of this type has an optimum response to light having a wavelength in the range of between 6000–8000 angstroms. The logic and control unit L controls the transport of the belt 60 in the direction of arrow B such that during optical copying segment 60*a* is located to be exposed line-by-line by the optical exposure assembly 50, and during nonimpact printing segment 60*b* is located so as to be exposed line-by-line by the electronically controlled light emitting assembly 52. In this manner, it is assured that the belt has optimum light response characteristics for respectively maximizing the ability of the image receiving member to accept formation of the latent image charge patterns thereon by the optical exposure assembly and the electronically controlled light emitting assembly.

In either optical copying or nonimpact printing, the respective segment (60*a* or 60*b*) of the belt 60 containing the appropriately formed latent image charge pattern is successively transported in the direction of arrow B through the electrostatographic process stations. Specifically, such segment is first brought into operative association with the developer station 32 where pigmented marking particles are caused to adhere to the charge pattern to develop a transferable image. Thereafter the area of the belt containing the developed transferable image is transported beneath the transfer charger 34 where a receiver member is brought into registered contact therewith. The receiver member, at a proper time determined by the logic and control unit L, is fed by mechanism 40 from a stack of receiver members (e.g., cut sheets of plain bond paper) in a cassette 82 to the registration mechanism 42 to adjust the timing of the transport of the receiver member with respect to the transport of the belt 60 so that the member is delivered into contact with the belt at the vicinity of the transfer charger 34 in register with the transferable image on the belt. As the receiver member and the belt pass beneath the transfer charger 34, such charger is activated to generate an electrical field which causes the marking particles to transfer from the belt to the receiver member. After transfer, the receiver member passes from the belt 60 to the fuser assembly 36 where the transferred image is fixed to the member by heat and/or pressure, and delivered through an exit slot 64 in the housing 12 for operator retrieval of the finished reproduction. Substantially simultaneously the belt is transported through a cleaning station 38 where any residual marking particles are removed prior to reuse of that segment of the belt.

The invention has been described in detail with particular reference to a preferred embodiment thereof, but it will be understood that variations and modifications can be effected within the spirit and scope of the invention as described hereinabove and as defined in the appended claims.

I claim:

1. For use in an electrostatographic reproduction apparatus having means for producing a direct light image of a document for optical copying of such document, means producing an electronically generated light image of information for nonimpact printing of such information, a photoconductive image receiving member upon which visible light and electronically generated light images are exposed to produce corresponding latent image charge patterns, said photoconductive image receiving member comprising:

a first portion having light responsive characteristics optimized in the range of light produced by said direct light image producing means; and a second portion, in an adjacent area along the length of said image receiving member, having light responsive characteristics optimized in the range of light produced by said electronically generated light image producing means.

2. The invention of claim 1 wherein said direct light image producing means produces light in the visible range, and said first portion of said photoconductive image receiving member is responsive to light having a wavelength in the range of approximately 4000–7000 angstroms.

3. The invention of claim 1 wherein said electronically controlled light producing means produces light biased toward the infrared range, and said second portion of said photoconductive image receiving member is responsive to light having a wavelength in the range of approximately 6000–8000 angstroms.

4. The invention of claim 1 wherein said direct light image producing means produces light in the visible range, and said first portion of said photoconductive image receiving member is responsive to light having a wavelength in the range of approximately 4000–7000 angstroms; and wherein said electronically controlled light producing means produces light biased toward the infrared range, and said second portion of said photoconductive image receiving member is responsive to light having a wavelength in the range of approximately 6000–8000 angstroms.

5. The invention of claim 1 wherein said first and second portions of said photoconductive member are respective sheets of flexible material connected in end-to-end relationship to form a continuous loop.

6. An electrostatographic reproduction apparatus capable of optical copying and nonimpact printing, said reproduction apparatus comprising:

means for producing a direct visible light image of a document for optical copying of such document;

means producing an electronically generated light image, biased toward the infrared range, of information for nonimpact printing of such information;

a photoconductive image receiving member upon which visible light and electronically generated light images are exposed to produce corresponding latent image charge patterns, said photoconductive image receiving member including a first portion having characteristics optimized to be responsive to light in the range of visible light produced by said visible light image producing means, a second portion having characteristics optimized to be responsive to light in the range of light produced by said electronically generated light image producing means; and means for controlling said visible light image producing means to expose said first portion of said photoconductive image receiving member to form a latent image thereon corresponding to a document to be optically copied, and for controlling said electronically generated light image producing means to expose said second portion of said photoconductive image receiving member to form a latent image thereon corresponding to information to be nonimpact printed.

7. The invention of claim 6 wherein said first portion of said photoconductive image receiving member is responsive to light having a wavelength in the range of approximately 4000–7000 angstroms, and said second portion of said photoconductive image receiving member is responsive to light having a wavelength in the range of approximately 6000–8000 angstroms.

* * * * *